US010072606B2

(12) United States Patent
Brunner

(10) Patent No.: US 10,072,606 B2
(45) Date of Patent: Sep. 11, 2018

(54) INTERNAL COMBUSTION ENGINE COMPRISING A CYLINDER HEAD

(71) Applicant: AVL LIST GMBH, Graz (AT)

(72) Inventor: Mario Brunner, Graz (AT)

(73) Assignee: AVL List GmbH, Graz (AT)

( * ) Notice: Subject to any disclaimer, the term of this patent is extended or adjusted under 35 U.S.C. 154(b) by 175 days.

(21) Appl. No.: 15/035,415

(22) PCT Filed: Nov. 3, 2014

(86) PCT No.: PCT/EP2014/073530
§ 371 (c)(1),
(2) Date: Jun. 13, 2016

(87) PCT Pub. No.: WO2015/067550
PCT Pub. Date: May 14, 2015

(65) Prior Publication Data

US 2016/0290279 A1 Oct. 6, 2016

(30) Foreign Application Priority Data

Nov. 8, 2013 (AT) ..... 50750/2013

(51) Int. Cl.
*F02F 1/24* (2006.01)
*F02F 11/00* (2006.01)
*F02M 61/14* (2006.01)

(52) U.S. Cl.
CPC ..... *F02F 11/002* (2013.01); *F02F 1/24* (2013.01); *F02M 61/14* (2013.01);
(Continued)

(58) Field of Classification Search
CPC ..... F02F 11/002; F02F 1/24; F02M 61/14; F02M 2200/8038; F02M 2200/8053; F02M 2200/85; F02M 2200/855; F02M 2200/858
(Continued)

(56) References Cited

U.S. PATENT DOCUMENTS 809,053 A * 1/1906 Leslie ..... C04B 35/652 106/796
4,112,906 A * 9/1978 Spencer ..... F02F 1/166 123/193.5
(Continued)

FOREIGN PATENT DOCUMENTS

AT 505049 10/2008
DE 1249010 8/1967
(Continued)

OTHER PUBLICATIONS

English Abstract of JPH11132100.
English Abstract of JP2002188547.

*Primary Examiner* — Marguerite McMahon
(74) *Attorney, Agent, or Firm* — Dykema Gosssett PLLC

(57) ABSTRACT

The invention relates to an internal combustion engine comprising a cylinder head (1) with a fire deck (7) on the combustion chamber side, at least one injector sleeve (2) detachably connected to the cylinder head (1) for mounting an injection unit, wherein the injector sleeve (2) is screwed to the fire deck (7) on a fire-deck-side first end (5) via a first screw connection (4), and wherein the injector sleeve (2) comprises in the region of the first end (5) at least one radially protruding first bearing area (9) with a first contact face (10) facing the fire deck (10), which contact face rests on a first counter surface (11) formed by the cylinder head (1). In order to increase the rigidity of the cylinder head (1) at low material cost, it is provided that the injector sleeve
(Continued)

(2)—preferably in the region of a second end (6) facing away from the first end (5)—comprises at least one radially protruding second bearing area (12) with a second contact face (13) facing the fire deck (7), which contact face rests on a second counter surface (14) formed by the cylinder head (1).

11 Claims, 1 Drawing Sheet

(52) U.S. Cl.
CPC ..... *F02M 2200/8038* (2013.01); *F02M 2200/8053* (2013.01); *F02M 2200/85* (2013.01); *F02M 2200/855* (2013.01); *F02M 2200/858* (2013.01)

(58) Field of Classification Search
USPC ..... 123/193.5
See application file for complete search history.

(56) References Cited

U.S. PATENT DOCUMENTS

| | | | | |
|---|---|---|---|---|
| 4,625,682 | A | 12/1986 | Dietrich et al. | |
| 5,169,176 | A * | 12/1992 | Brossard | B29C 61/0658 156/84 |
| 5,295,462 | A * | 3/1994 | Barnes | F01L 3/22 123/193.5 |
| 5,345,913 | A * | 9/1994 | Belshaw | F02M 57/02 123/470 |
| 6,314,936 | B1 * | 11/2001 | .ANG.ngstrom | F02M 61/14 123/305 |
| 2011/0061217 | A1 | 3/2011 | Shevela et al. | |
| 2011/0083624 | A1 * | 4/2011 | Megel | F02F 1/242 123/41.82 R |

FOREIGN PATENT DOCUMENTS

| | | |
|---|---|---|
| GB | 363560 | 12/1931 |
| GB | 725212 | 3/1955 |
| JP | S54158920 | 11/1979 |
| JP | H11132100 | 5/1999 |
| JP | 2002188547 | 7/2002 |

* cited by examiner

INTERNAL COMBUSTION ENGINE COMPRISING A CYLINDER HEAD

This application is a national stage of PCT/EP2014/073530, filed 3 Nov. 2014, which was based on Austrian Application A50750/2013, filed 8 Nov. 2013. All priorities are claimed.

BACKGROUND OF THE INVENTION

Field of the Invention

The invention relates to an internal combustion engine having a cylinder head with a fire deck on the combustion chamber side, at least one injector sleeve detachably connected to the cylinder head for accommodating an injection device, the injector sleeve being screwed to the fire deck on a first end on the fire deck side via a first screw connection, and wherein the injector sleeve includes in the region of the first end at least one radially-protruding first bearing area with a first contact face facing the fire deck, which contact face rests on a first counter surface formed by the cylinder head.

The Prior Art

Elastic deformations of the fire deck occur under ignition pressure in operation of the internal combustion engine, thus leading to relative movement between the injector sleeve and the fire deck. This can lead to leakages between the fire deck and the injector sleeve.

An internal combustion engine with a cylinder head having an injector sleeve is known from GB 363 560 A, wherein the injector sleeve formed for accommodating an injection device is screwed to an upper deck of the cylinder head via a flange surface. The injector sleeve is pressed against a sealing surface of the fire deck as a result of the screw connection.

JP 11-132100 A describes a cylinder head structure with a fire deck on the combustion chamber side and an upper deck spaced from the fire deck, wherein a central injector sleeve for accommodating an injection device is provided per cylinder. The injector sleeve is screwed to the upper deck via a first screw connection and to the fire deck of the cylinder head via a second screw connection.

A mount for an injector sleeve of a cylinder head is further known from JP 2002-188547, wherein the injector sleeve is screwed into the cylinder head in the region of the fire deck.

It is proposed in AT 505 049 B1 to fasten the injector sleeve to the cylinder head via two screw connections, wherein the screw connections are arranged in the region of the mutually averted ends of the injector sleeve.

It is further known to fix the injector sleeve only by one screw connection in the region of the fire deck in the cylinder head. Deformations of the fire deck occur in this case under ignition pressure, as a result of which the sleeve is entrained.

The movements of the injector sleeve can also lead to leakages in the long-term in this case too.

It is the object of the invention to avoid these disadvantages and to increase the stiffness of the cylinder head with a low input of material. A tight connection offering a long operational lifespan between the injector sleeve and the cylinder head is to be created.

SUMMARY OF THE INVENTION

It is achieved in accordance with the invention in such a way that the injector sleeve, preferably in the region of a second end facing away from the first end, comprises at least one radially protruding second bearing area with a second contact face facing the fire deck, which contact face rests on a second counter surface formed by the cylinder head.

It is especially advantageous if in the relaxed or dismounted state the distance between the first counter surface and the second counter surface of the cylinder head is greater than the distance between the first contact face and the second contact face of the injector sleeve, so that in the screwed-in state the injector sleeve and the first screw connection are under a tensile pretension produced by a pre-tensile force on the injector sleeve installed in the cylinder head.

A pretensioning of the injector sleeve thus occurs during mounting of the injector sleeve. Additional pretensioning of the injector sleeve occurs in operation under loading by the thermal expansion of the cylinder head, which additional pretensioning counteracts the thermal free expansion of the cylinder head and prevents the same. A relief of the pretensioning of the injector sleeve occurs under loading by the cylinder pressure. The pre-tensile force must therefore be designed to such a high extent that lift-off of the injector sleeve by the maximum cylinder pressure is prevented.

An external thread of the injector sleeve can be part of the first screw connection. It is provided in a simple embodiment with few components that the external thread of the injector sleeve is screwed into a threaded borehole of the fire deck.

It can be provided alternatively thereto that the external thread of the injector sleeve is screwed together with a nut supported on a contact face of the fire deck, which nut is arranged from the side of the combustion chamber in a borehole of the fire deck. In this variant, the production of a thread in the injector borehole of the cylinder head can be omitted, thus preventing tensions in the fire deck occurring by the first screw connection.

Especially under high cylinder pressures it is advantageous for protection against loosening of the injector sleeve that the injector sleeve, in the region of the second end, is screwed together with the cylinder head via a second screw connection by way of an element preferably formed by a hollow screw, wherein the second contact face of the injectors sleeve is pressed against the second counter surface of the cylinder head by the second screw connection. In this process, the element can act with a pressure surface facing the injector sleeve on an engagement surface of the injector sleeve in the region of its second end. The second screw connection prevents lifting of the injector sleeve by the gas forces in the cylinder chamber.

The first contact face can be glued together with the first counter surface and/or the second contact face with the second counter surface as an alternative or in addition to the second screw connection.

With the described invention, deflection of the fire deck and the occurring tensions by the ignition pressure can be reduced without requiring higher material input in the cylinder head.

BRIEF DESCRIPTION OF THE DRAWINGS

The invention will be explained below by reference to the enclosed drawings, wherein.

DETAILED DESCRIPTION OF THE DEPICTED EMBODIMENTS

Figure 1:
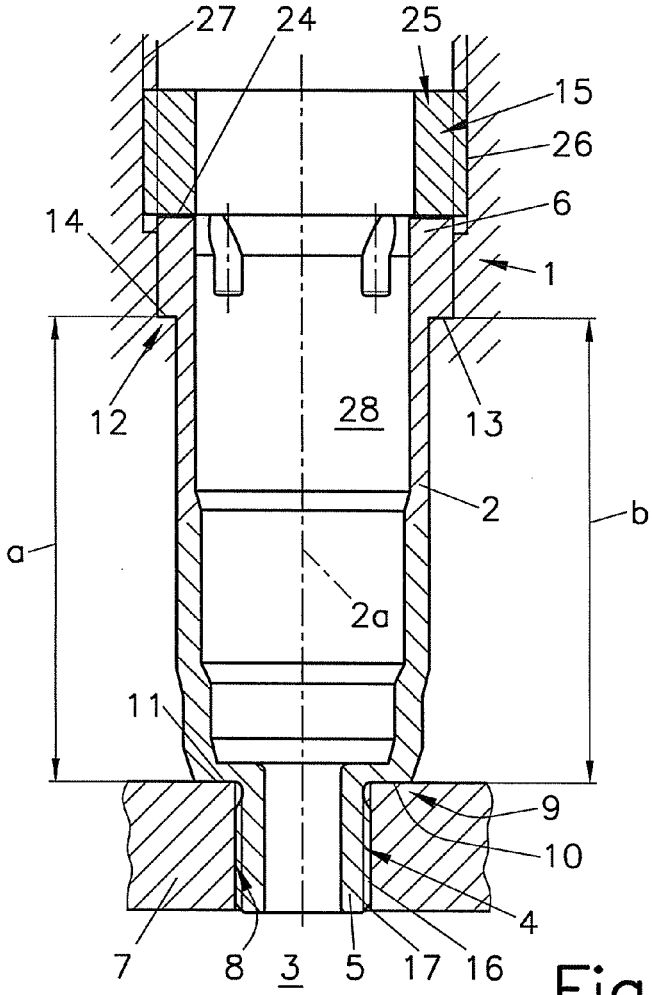
FIG. 1 shows an injector sleeve for an internal combustion engine in accordance with the invention in a meridian sectional view in a first embodiment.
Figure 2:
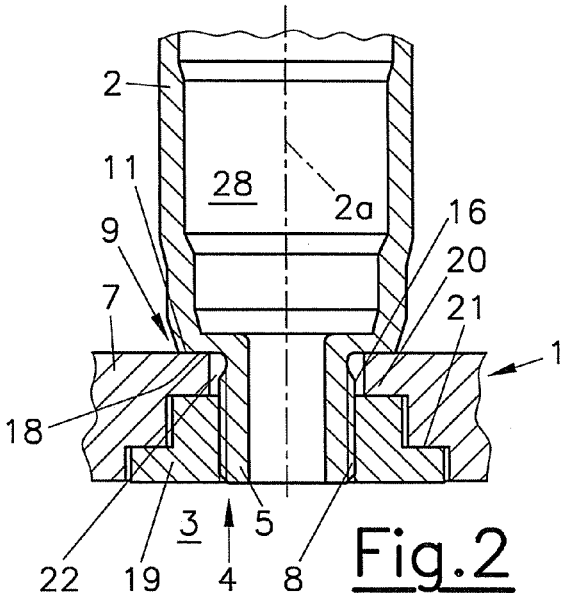
FIG. 2 shows an injector sleeve in a partial sectional view in a second embodiment.

FIGS. 1 and 2 each show an injector sleeve 2 arranged in a cylinder head 1 for accommodating an injection device which opens into a combustion chamber 3 of an internal combustion engine and which is not shown in further detail. Reference numeral 28 designates the cavity within the injector sleeve 2 for accommodating the injection device.

The injector sleeve 2 is detachably connected via a first screw connection 4 in a fire deck 7 of the cylinder head 1 adjoining the combustion chamber 3, and comprises a first end 5 in the region of the fire deck 7 and a second end 6 facing away from the first end 5. In the region of the first end 5, the injector sleeve 2 comprises an external thread 16 which interacts with a respective internal thread 8 for fastening in the cylinder head 1.

In the embodiment shown in FIG. 1, the internal thread 8 is formed by a threaded borehole 17 of the fire deck 7 of the cylinder head 1. FIG. 2 on the other hand shows an embodiment in which the internal thread 8 is formed by a nut 19 which rests on shoulders 20, 21 of the fire deck 7. The nut 19 is arranged in the borehole 22 of the fire deck 7 from the side of the combustion chamber 3.

At least one radially-protruding first bearing area 9 with a first contact face 10 facing the fire deck 7 is arranged in the region of the first end 4 of the injector sleeve 2, which contact face rests on a first counter surface 11 formed by the cylinder head 1.

In the region of the second end 6, the injector sleeve 2 comprises at least one second bearing area 12 with a second contact face 13 facing the fire deck 7, which second bearing area protrudes radially to the outside. The second contact face 13 rests on a second counter surface 14 formed by the cylinder head 1.

In the embodiment, the first contact face 10 and the first counter surface 11 are formed as flat annular surfaces normally to the axis 2a of the injector sleeve 2. The first contact face 10 and the first counter surface 11 can also be formed as corresponding conical surfaces. The same applies to the second contact face 13 and the second counter surface 14.

In the relaxed state, in which all contact faces 10; 13 and counter surfaces 11; 14 do not touch each other, i.e. when the injector sleeve 2 has not yet been screwed into the cylinder head 1 for example, the distance a between the first counter surface 11 and the second counter surface 14 of the cylinder head 1 is greater than the distance b between the first contact face 10 and the second contact face 13 of the injector sleeve 2. As a result, in the screwed-in state the injector sleeve 2 is subject to a tensile pretension produced by a pre-tensile force, wherein the first screw connection 4 is formed in order to exert the pre-tensile force on the injector sleeve 2 installed in the cylinder head 1. The pre-tensile force must be selected to be at least so high that a lift-off of the injector sleeve 2 is prevented by the maximum cylinder pressure produced during the combustion in the combustion chamber 3.

For additional securing, an element can be screwed together with the cylinder head 1 by a second screw connection 15 in the region of the second end 6 of the injector sleeve 2, which element presses the second contact face 13 against the second counter surface 14, in addition to the pre-tensile force. The element formed by a hollow screw 24 in the illustrated embodiment in FIG. 1 acts with a pressure surface 23 facing the injector sleeve 3 on an oppositely directed engagement surface 24 of the injector sleeve 2 in the region of the second end 6. The second screw connection 15 comprises an external thread 26 on the hollow screw 25 in the embodiment shown in FIG. 1, which external thread is screwed into an internal thread 27 of the cylinder head 1. The second screw connection 15 securely prevents a lift-off of the injector sleeve 2 caused by the gas forces in the combustion chamber 3, especially a lift-off of the first contact face 10 from the first counter surface 11, said contact face 10 forming a sealing surface 18.

It can also be provided alternatively or in addition to the second screw connection 15 that the first contact face 10 is glued together with the first counter surface 11 and/or the second contact face 13 with the second counter surface 14 by means of an adhesive.

Each of the described embodiments can prevent deflection of the fire deck 7 and the occurring tensions by the ignition pressure without requiring higher material input in the cylinder head 1. This allows a very stiff configuration of the cylinder head 1 and a low weight.

The invention claimed is:

1. An internal combustion engine, comprising a cylinder head with a fire deck on the combustion chamber side, at least one injector sleeve detachably connected to the cylinder head for accommodating an injection device, wherein the injector sleeve is screwed to the fire deck on a first end on the fire deck side via a first screw connection, and wherein the injector sleeve comprises in the region of the first end a radially-protruding first bearing area with a first contact face facing the fire deck, which first contact face rests on a first counter surface formed by the cylinder head, wherein the injector sleeve comprises a radially-protruding second bearing area with a second contact face facing the fire deck, which second contact face rests on a second counter surface formed by the cylinder head, and wherein in a relaxed state a distance between the first counter surface and the second counter surface of the cylinder head is greater than a distance between the first contact face and the second contact face of the injector sleeve, so that in a screwed-in state the injector sleeve is under a tensile pretension produced by a pre-tensile force.

2. The internal combustion engine according to claim 1, wherein the first screw connection is formed to exert the pre-tensile force on the injector sleeve installed in the cylinder head.

3. The internal combustion engine according to claim 1, wherein the pre-tensile force is formed to be at least so high that a lift-off of the injector sleeve by the maximum cylinder pressure is prevented.

4. The internal combustion engine according to claim 1, wherein an external thread of the injector sleeve in the region of the fire deck is part of the first screw connection.

5. The internal combustion engine according to claim 4, wherein the external thread of the injector sleeve is screwed into a threaded borehole of the fire deck.

6. The internal combustion engine according to claim 4, wherein the external thread of the injector sleeve is screwed together with a nut supported on at least one shoulder of the fire deck, said nut being arranged from the side of the combustion chamber in a borehole of the fire deck.

7. The internal combustion engine according to claim 1, wherein an element is screwed together in the region of the second end with the cylinder head by a second screw connection, wherein the second contact face of the injector sleeve is pressed by the second screw connection against the second counter surface of the cylinder head.

8. The internal combustion engine according to claim 7, wherein the element acts with a pressure surface facing the injector sleeve on an engagement surface of the injector sleeve in the region of its second end.

9. The internal combustion engine according to claim 1, wherein the first contact face is glued together with the first counter surface and/or the second contact face with the second counter surface.

10. The internal combustion engine according to claim 1, wherein said a radially-protruding second bearing of the injector sleeve is arranged in the region of a second end facing away from the first end.

11. The internal combustion engine according to claim 7, wherein the element is a hollow screw.

* * * * *